United States Patent [19]

Jones

[11] Patent Number: 4,973,044

[45] Date of Patent: Nov. 27, 1990

[54] CONVALESCENT AID

[76] Inventor: Robert M. Jones, 5281 Tamiami Ct., Cape Coral, Fla. 33904

[21] Appl. No.: 243,224

[22] Filed: Sep. 2, 1988

Related U.S. Application Data

[63] Continuation of Ser. No. 935,815, Nov. 28, 1986, abandoned.

[51] Int. Cl.[5] ..... A63B 23/04

[52] U.S. Cl. ..... 272/70.3; 5/83; 128/25 R; 272/DIG. 6

[58] Field of Search ..... 272/70, 70.3, 70.4, 272/114, 63, 70 A, DIG. 6; 128/25 R, 25 B; 59/21; 119/29; 5/81 R, 81 B, 81 C, 83, 87, 84; 294/140, 142

[56] References Cited

U.S. PATENT DOCUMENTS

| | | | |
|---|---|---|---|
| 2,327,671 | 8/1943 | Rupprecht | 272/70.3 |
| 2,625,202 | 1/1953 | Richardson et al. | 272/70.3 |
| 2,903,238 | 9/1959 | Flandrick | 272/70.3 X |
| 3,252,704 | 5/1966 | Wilson | 272/70.3 |
| 3,568,226 | 3/1971 | Mater et al. | 272/70.4 |
| 3,621,819 | 11/1971 | Hooper | 272/70.3 X |
| 3,730,587 | 5/1973 | Bloxham et al. | 272/70 A X |
| 3,877,421 | 4/1975 | Brown | 128/25 R |
| 3,981,274 | 9/1976 | Curtis | 119/29 |
| 3,999,228 | 12/1976 | Thomas | 5/81 R X |
| 4,244,021 | 1/1981 | Chiles III | 272/DIG. 6 |
| 4,252,063 | 2/1981 | Brooks, Jr. | 128/25 R X |
| 4,408,613 | 10/1983 | Relyea | 272/DIG. 6 X |
| 4,549,732 | 10/1985 | Hoffman | 272/70 |
| 4,571,758 | 2/1986 | Samuelsson | 5/87 X |
| 4,642,769 | 2/1987 | Petrofsky | 272/DIG. 6 |

*Primary Examiner*—Richard J. Apley
*Assistant Examiner*—H. Flaxman
*Attorney, Agent, or Firm*—Barnes & Thornburg

[57] ABSTRACT

A convalescent aid utilized to allow a patient to continuously walk in a circular walkway while being supported from above. The support includes a support arm rotatably mounted on a central column, with a hoist attached adjacent one end of the support arm and a harness suspended from the hoist at the opposite end of the support arm. The aid further includes a brake to control the relative pivotal movement between the support arm and the central column, as well as a counterbalance positioned between the arm and column to suspend a portion of the weight of a patient in the harness. In addition, the device includes a load detecting structure capable a determining the load exerted by the patient on the harness. The entire device is controlled by a programmable machine.

10 Claims, 2 Drawing Sheets

CONVALESCENT AID

This is a continuation of application Ser. No. 935,815, filed on 11/28/86 and abandoned on 9/2/88.

This invention relates to convalescent aids, and particularly to physical therapy devices such as exercise walkers or physical therapy walkers. While the invention is disclosed in the context of a convalescing human patient, it is to be understood that the invention may find equal utility as an aid to a convalescing animal such as, for example, a horse with a leg injury.

Various types of convalescent walkers or physical therapy walkers and related types of apparatus are known. By way of example, but not intended to be an exhaustive listing of the prior art in this field, there are the following U.S. Pat Nos. 2,327,671; 2,812,010; 2,871,915; 3,730,587; 4,164,350; and 4,256,098. While these patents do provide some general guidance in the construction and use of mechanisms of this general type, they do not provide many forms of control over several aspects of convalescence, such as, for example, the amount of a convalescing patient's own weight the patient bears during a physical therapy session, and the time or distance the convalescing patient is to walk during a particular physical therapy session.

According to one aspect of the invention, a physical therapy device comprises a supporting column, an arm, means for rotatably and pivotally mounting the arm from the column, a harness, and means for suspending the harness from the arm. A walkway extends around the supporting column generally beneath the harness as the arm moves about its rotational mounting to the supporting column.

Illustratively according to this aspect of the invention, the apparatus further comprises a brake and means for mounting the brake on the supporting column. The brake brakes relative motion between the arm and the supporting column.

Additionally according to this aspect of the invention, the apparatus further comprises a counterbalance and means for mounting the counterbalance from one of the supporting column and the arm. The counterbalance acts between the supporting column and arm to suspend a portion of the weight of a patient in the harness.

Further according to this aspect of the invention, the apparatus further comprises means for detecting the load exerted by a convalescing patient on the harness and means for mounting the load detecting means between the harness and the arm.

According to this aspect of the invention, the apparatus further comprises means for detecting the load exerted by a convalescing patient on the harness and means for mounting the load detecting means between the harness and the arm.

According to this aspect of the invention, the means for rotatably and pivotally mounting the arm from the supporting column comprises a yoke, means for rotatably mounting the yoke from the supporting column, and means for pivotally mounting the arm from the yoke. The axis of rotation of the yoke on the supporting column and the pivotal axis of the arm on the yoke are generally orthogonal to each other.

According to another aspect of the present invention, a physical therapy device or convalescent walker comprises a supporting column, a yoke, means for pivotally mounting the yoke from the column, an arm, means for pivotally mounting the arm to the yoke, a hoist, means for mounting the hoist on the arm, a harness, and means for suspending the harness from the hoist. A walkway extends around the supporting column and is defined generally beneath the harness as the arm moves about its rotational mounting to the supporting column.

According to an illustrative embodiment of this aspect of the invention, means are provided for mounting the hoist adjacent one end of the arm. Additionally the invention comprises a sheave and means for mounting the sheave adjacent the other end of the arm. The means for suspending the harness from the hoist extends over the sheave between the harness and the hoist.

Additionally, according to an illustrative embodiment, the means for rotatably and pivotally mounting the arm from the column comprises a yoke, means for rotatably mounting the yoke from the supporting column and means for pivotally mounting the arm from the yoke.

Further, according to an illustrative embodiment, the invention comprises a brake and means for mounting the brake on the supporting column. The brake brakes relative motion between the arm and the supporting column. Illustratively, this relative motion is between the yoke and the supporting column.

Additionally, according to an illustrative embodiment, the invention comprises a counterbalance and means for mounting the counterbalance from one of the yoke and arm. The counterbalance acts between the yoke and arm to suspend a portion of the weight of the patient in the harness.

Further, illustratively, the apparatus includes means for detecting the load exerted by the convalescing patient on the harness and means for mounting the load-detecting means between the arm and the hoist. Illustratively, the load-detecting means comprises a load cell.

The invention may best be understood by referring to the following description and accompanying drawings which illustrate the invention. In the drawings.

Figure 2:
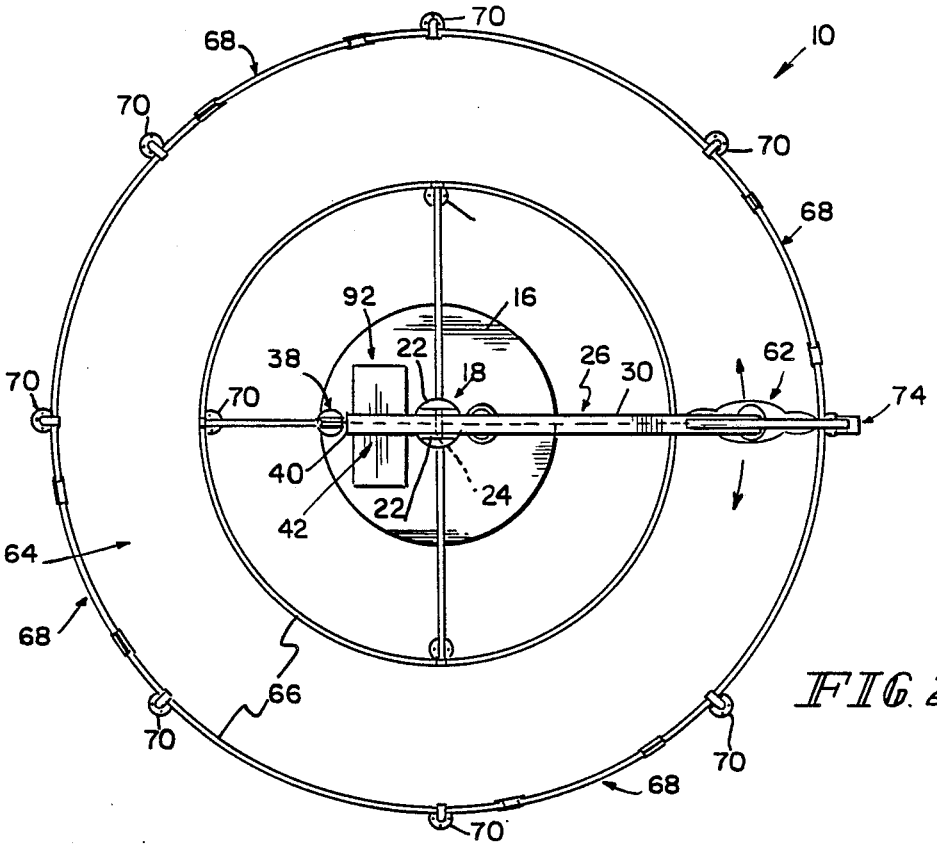
FIG. 2 illustrates a top plan view of the apparatus of FIG. 1.
Figure 1:
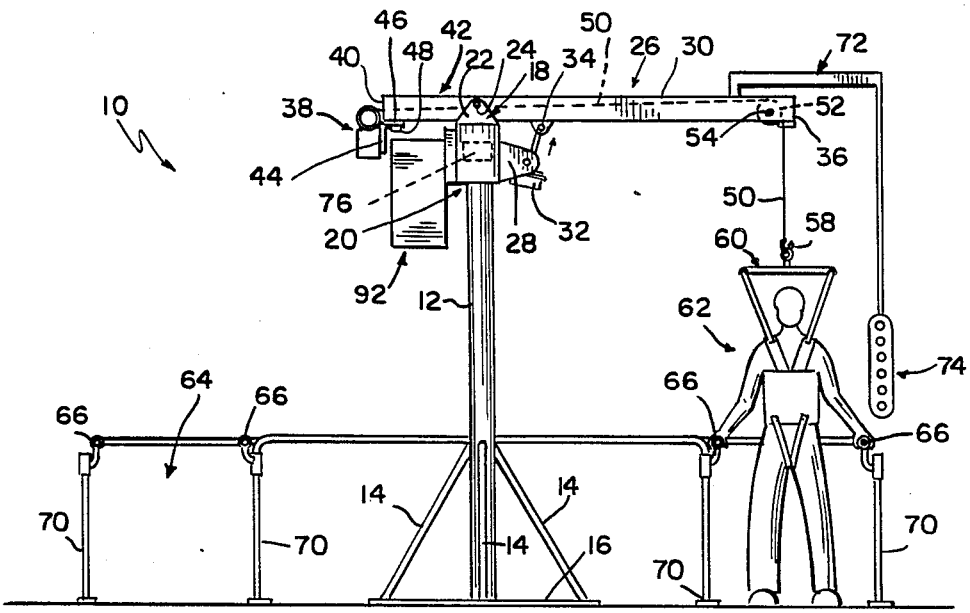
FIG. 1 illustrates a side elevational view of an apparatus constructed according to the present invention.

Referring particularly to FIGS. 1–2, the physical therapy device, or convalescent walker 10 includes a supporting column 12 which extends generally vertically and is maintained in vertical orientation by four equally-spaced radially outwardly and axially downwardly extending legs 14. Column 12 and legs 14 are mounted on a foot 16 which can be cross-shaped, circular or of any other suitable shape. The column 12 is capped by a yoke 18 which is rotatably mounted on the top 20 of the column 12 about a vertical axis extending through column 12. Yoke 18 includes upwardly extending gudgeons 22. A pivot pin 24 extends horizontally through aligned apertures in gudgeons 22 and in a generally horizontally extending arm 26 positioned between the gudgeons 22. A support 28 extends outward from the yoke 18 in the direction of the longer extent 30 of arm 26. Support 28 supports an air counterbalance 32 which can be an inflatable air bag or compressed air-driven shock absorber type mechanism. The air counterbalance 32 acts between the support 28 and an attachment point 34 on the underside of the longer extent 30 of arm 26. By regulating the air pressure in the air counterbalance 32, the patient supported from the distal end 36 of arm 26 is more or less supported by the air counterbalance 32.

A small electric motorized hoist 38 is mounted at the distal end 40 of the shorter extent 42 of arm 26. The mounting of the hoist 38 is by means of a hinge, the axis of which is generally parallel to the axis of the pivot pin 24. This permits pivoting of the hoist 38 about an axis generally perpendicular to the longitudinal extent of arm 26. A mounting bracket 44 is attached to the leaf of the hinge to which hoist 38 is attached. The other leaf of the hinge is attached to the distal end 40 of the shorter extent 42 of arm 26. A similar mounting bracket 46 is attached to the underside of the shorter extent 42 of arm 26 in close proximity to mounting bracket 44. A load cell 48 is positioned between brackets 44, 46 so that the load on the hoist 38 is transmitted to the load cell 48 and results in the load cell 48 providing an electrical signal indicative of the load on the cable 50 wound on hoist 38. The cable 50 extends along the length of the arm 26 to a sheave 52 which is pivotally mounted at 54 adjacent end 36 of arm 26.

Cable 50 is terminated by a hook 58 which is adapted to enqage an eye provided on a harness 60 for supporting the recuperating patient 62. Rotation of the arm 26 about the pivot axis of the yoke 18 and column 12 (generally the center line of column 12) causes the harness 60 to trace a circular path 64 on the surface upon which column 12 stands. This circular path 64 is bounded by vertically adjustable inner and outer circular handrails 66, the outer handrail of which is provided with access gates 68. The handrails 66 are supported upon stanchions 70 which are mounted to the surface upon which column 12 stands, typically by threaded fasteners through flanges provided at the feet of the stanchions 70.

A support 72 extends outward from the distal end 36 of arm 26 and supports a pendent control housing 74 in the area of the convalescing patient's hand. A brake 76, which may be controlled by spring, compressed air or electricity, is mounted between the column 12 and the yoke 18 to control the rate of rotation of arm 26 about the axis of column 12.

Figure 3:
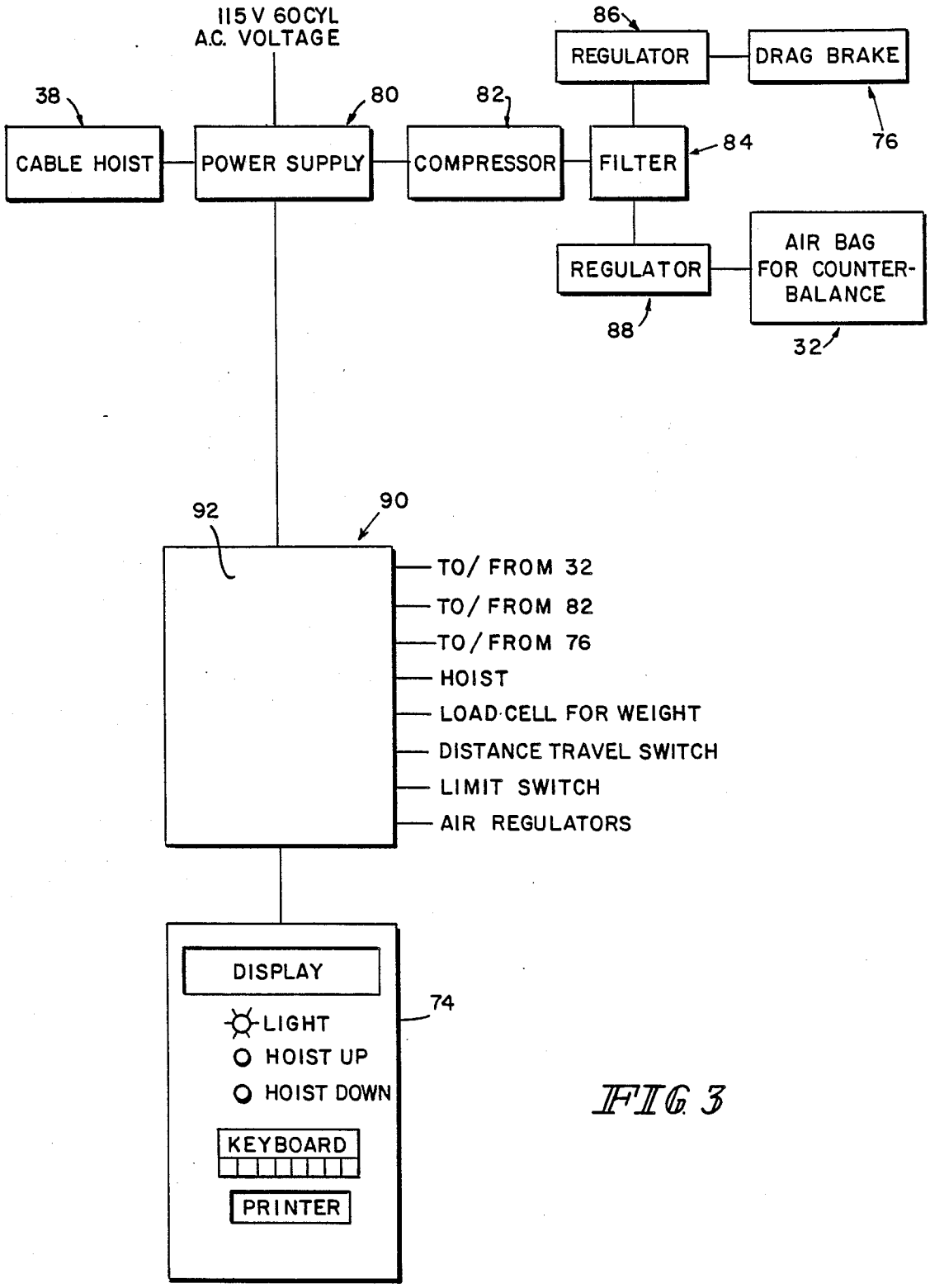
FIG. 3 illustrates a block diagram of the electrical system for operating the apparatus of FIGS. 1–2.

Turning now to FIG. 3, electrical power is supplied from, for example, a 115 VAC, 60 Hz line to a power supply 80. Power at appropriate voltages and currents is supplied from supply 80 to the hoist 38 and to an air compressor 82 which provides compressed air through a filter 84 to two regulators 86, 88. Compressed air is provided from regulator 86 to operate the brake 76, where the brake is an air-operated brake. Compressed air from regulator 88 is provided to the air counterbalance 32. Power is also supplied from power supply 80 to a computer 90 which operates the system illustrated in FIGS. 1–2. Illustratively, the computer 90 is one of the commercially available personal-type computers, such as a Tandy TRS80 Model 102 or equivalent. The computer 90, along with power supply 80, compressor 82, filter 84 and regulators 86, 88 can be housed within a control cabinet 92 mounted on yoke 18 (FIGS. 1–2).

Input/output signals to/from the computer 90 are provided by/to the air counterbalance 32, the compressor 82, the brake 76, the hoist 38, the load cell 48, switch 56 and air regulators 86, 88. An additional input to the computer 90 is provided by an odometer 94 which counts the rotations and partial rotations of arm 26 about the pivot axis of column 12. The odometer 94 provides a "distance traveled" input signal to computer 90. Computer 90 also receives input signals from, and provides output signals to, controls in the pendent control housing 74. Typically these signals include the amount or percentage of the patient's weight being supported by the system 10, an elapsed exercise time or an odometer reading, "hoist up" and "hoist down" signals indicating the operating status of hoist 38, ASCII, or other machinereadable, characters which instruct the computer, for example, to indicate the amount or percentage of the patient's weight the patient is to bear during a physical therapy session, and commands to a printer to cause it to print such information as the duration, either in time or in distance traveled, of a physical therapy session, the amount or percentage of a patient's weight the patient bore during the physical therapy session, the patient's name and/or other identifying information, and the like.

It will be immediately appreciated that the apparatus of the present invention will permit substantial labor savings in the physical therapy department of a hospital, for example, as well as increasing safety by reducing the likelihood of a recuperating patient falling. This apparatus also permits the attending physician to have much greater control over the recuperating patient's physical therapy, by permitting the physician to select not only the distance or time the patient walks, but also, the amount or percentage of the patient's weight that the patient must bear during physical therapy sessions.

The circular path 64 between handrails 66 is also wide enough that a conventional walker can be placed in the path 64 for the patient to use during physical therapy in order to learn how to use the walker. The controls on the control housing 74 permit the physical therapist to set the distance or time to be walked, and the amount of the patient's total weight that the patient is to bear during the physical therapy session. After the distance is traveled or the time has elapsed, an alarm sounds so that the therapist can attend to, for example, transferring the patient back to a wheelchair to be returned to his or her room. The brake 76 permits the patient to walk at his or her own pace, while still providing stability.

In addition to adjusting the amount of the patient's weight that the patient is to bear during a physical therapy session, the hoist 38 can be used to hoist the patient from, and return the patient to, a wheelchair. The computer 90 permits rapid set-up of the system, and the printer in the control cabinet 92 produces a printout of the conditions the patient has endured during therapy, as well as other information, such as a patient name, patient identification number, the amount of time and/or distance the patient walked, the amount or percentage of the patient's own weight that the patient bore during the therapy session, the patient's average walking speed during the therapy session and so on.

In operation, the switch 56 starts the compressor 82 and causes a red light to come on on the control cabinet 92 until the output air pressure of the compressor 82 reaches a safe operating range. If during the therapy session the compressor output pressure falls outside the safe operating range, the red light again comes on until the pressure is back within the safe operating range. The attending therapist or nurse secures the patient in the harness 60 and attaches the harness 60 by hook 58 to the cable 50 and hoist 38. The hoist 38 cannot be energized through the switch 56 until the air compressor safe operating range is achieved. At that time, the computer 90 generates a menu on the computer display in housing 74 that leads the therapist step-by-step through entry of the required data, such as patient name, patient identification number, patient's approximate weight (for operation of the brake 76), amount or percentage of patient's body weight to be supported by the air counterbalance 32, time or distance the patient is to walk, and the like. Then the patient is raised by operation of the hoist 38 and the treatment begins. After treatment is completed, the patient is lowered to the waiting wheelchair and the attending therapist depresses a "print" button on the control housing 74. The computer 90 causes all information pertinent to the recuperating patient's medical record to be printed by the printer in the control cabinet 92.

What is claimed is:

1. A physical therapy device comprising a supporting column, an arm, means for rotatably and pivotally mounting the arm from the column, a harness, means for suspending the harness from the arm, the means for suspending the harness from the arm including an electrically powered hoist, a cable trained about the hoist and coupled to the harness, and means for mounting the hoist from the arm, a walkway extending around the supporting column and defined generally beneath the harness as the arm moves about its rotational mounting to the supporting column, means for detecting the load exerted by a convalescing patient on the harness and means for mounting the load detecting means between the harness and the arm, a programmable machine for controlling the physical therapy device, the programmable machine provided with an input port, and means for coupling the load detecting means to the input port.

2. The apparatus of claim 1 and further comprising a counterbalance, means for mounting the counterbalance from one of the supporting column and the arm, the counterbalance acting between the supporting column and arm to suspend a portion of the weight of a patient in the harness, the programmable machine further including an output port, and means for coupling the counterbalance to the output port to control the portion of the weight of a patient supported by the device.

3. The apparatus of claim 2 and further comprising a brake, means for mounting the brake on the supporting column, the brake braking relative motion between the arm and the supporting column, the programmable machine including a second input port and a second output port, means for entering into the programmable machine desired braking information, means for coupling the desired braking information entry means to the second input port, and means for coupling the second output port to the brake to control the brake in accordance with the desired braking information.

4. The apparatus of claim 2 wherein the means for rotatably and pivotally mounting the arm from the supporting column comprises a yoke, means for rotatably mounting the yoke from the supporting column, and means for pivotally mounting the arm from the yoke.

5. The apparatus of claim 4 wherein the axis of rotation of the yoke on the supporting column and the pivotal axis of the arm on the yoke are generally orthogonal to each other.

6. A physical therapy device comprising a supporting column, an arm, a means for rotatably and pivotally mounting the arm from the column, a hoist, means for mounting the hoist on the arm, a harness, means for suspending the harness from the hoist, a walkway extending around the supporting column and defined generally beneath the harness as the arm moves about its rotational mounting to the supporting column, means for mounting the hoist adjacent one end of the arm, a sheave, means for mounting the sheave adjacent the other end of the arm, the means for suspending the harness from the hoist including a cable extending over the sheave between the harness and the hoist, the means for rotatably and pivotally mounting the arm from the column comprising a yoke, means for rotatably mounting the yoke from the column, and means for pivotally mounting the arm from the yoke, a counterbalance, means for mounting the counterbalance from one of the yoke and arm, the counterbalance acting between the yoke and arm to suspend a portion of the weight of a patient in the harness, means for detecting the load exerted by a convalescing patient on the harness, and means for mounting the load-detecting means between the arm and the hoist.

7. The apparatus of claim 6 and further comprising a brake and means for mounting the brake on the supporting column, the brake braking relative motion between the yoke and the supporting column.

8. The apparatus of claim 6 wherein the load-detecting means comprises a load cell.

9. The apparatus of claim 6 and further comprising a programmable machine for controlling the physical therapy device, the programmable machine including an input port for receiving signals from the load-detecting means, means for coupling the input port for receiving signals from the load-detecting means to the load-detecting means, an input port for entering into the controller a portion of the weight of a patient which the patient is to support during the exercise interval and the length of the exercise interval, an output port for controlling the counterbalance, and means for coupling the output port to the counterbalance.

10. The apparatus of claim 7 and further comprising a programmable machine for controlling the physical therapy device, the programmable machine including an input port for receiving signals from the load-detecting means, means for coupling the input port for receiving signals from the load-detecting means to the load-detecting means, an input port for entering into the programmable machine a portion of the weight of a patient which the patient is to support during the exercise interval and the length of the exercise interval, an output port for controlling the counterbalance, means for coupling the output port for controlling the counterbalance to the counterbalance, an output port for controlling the brake, and means for coupling the output port for controlling the brake to the brake.

* * * * *